US008848046B1

(12) United States Patent
Stofko et al.

(10) Patent No.: US 8,848,046 B1
(45) Date of Patent: Sep. 30, 2014

(54) KINETIC ENERGY ABSORBER AND METHOD FOR GUN-LAUNCHED PROJECTILE

(75) Inventors: Pavol Stofko, Milford, PA (US); Pasquale Carlucci, Fair Lawn, NJ (US); Mark Mellini, Denville, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 317 days.

(21) Appl. No.: 13/217,690

(22) Filed: Aug. 25, 2011

(51) Int. Cl.
*H04N 7/18* (2006.01)

(52) U.S. Cl.
USPC ..... 348/61

(58) Field of Classification Search
CPC ..... H04N 7/18
USPC ..... 348/61; 102/517, 502, 213; 244/3.11; 89/14.05; 293/133; 396/263
See application file for complete search history.

(56) References Cited

U.S. PATENT DOCUMENTS 7,913,626 B1 * 3/2011 Reinhardt et al. ..... 102/517
2008/0276821 A1 * 11/2008 Stancil ..... 102/502

* cited by examiner

*Primary Examiner* — Dave Czekaj
*Assistant Examiner* — Berteau Joisil
(74) *Attorney, Agent, or Firm* — Michael C. Sachs

(57) ABSTRACT

A round for launching from a gun may include a cartridge case and a projectile body adjacent the cartridge case. A pusher may be disposed in the cartridge case and may be operable to push the projectile body upon firing the round. An imaging sensor may be disposed at least partially in the projectile body. The imaging sensor may include a sensor base and a sensor lens. A first kinetic energy absorber may be disposed around the sensor base. A second kinetic energy absorber may be disposed around the sensor lens. After the round is fired and the pusher exits the gun, the pusher may separate from the projectile body and the second kinetic energy absorber may separate from the imaging sensor.

8 Claims, 5 Drawing Sheets

KINETIC ENERGY ABSORBER AND METHOD FOR GUN-LAUNCHED PROJECTILE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to kinetic energy absorbers and in particular to kinetic energy absorbers for protecting sensitive components of gun-launched projectiles.

A gun-launched projectile may experience acceleration forces throughout its flight, particularly at launch and at impact. The projectile may carry a payload such as, for example, one or more sensors. Sensor projectiles are being developed with increasing frequency to facilitate a variety of needs. Sensors and other devices carried by these projectiles are required to function after initial impact. Thus, the internal sensors and associated electronics in the projectile must not be damaged during the projectile's launch and impact.

Different types of materials configured in various ways have been used to protect sensitive devices from excessive acceleration forces. The placement of imaging sensors in gun-launched projectiles presents unique challenges for energy absorption. A need exists for an energy absorber to protect fragile sensors in gun-launched projectiles.

SUMMARY OF THE INVENTION

It is an object of the invention to provide an energy absorber to protect fragile sensors in gun-launched projectiles.

One aspect of the invention is a round for launching from a gun. The round may include a cartridge case and a projectile body adjacent the cartridge case. A pusher may be disposed in the cartridge case and operable to push the projectile body upon firing the round. An imaging sensor may be disposed at least partially in the projectile body. The imaging sensor may include a sensor base and a sensor lens. A first kinetic energy absorber may be disposed around the sensor base. A second kinetic energy absorber may be disposed around the sensor lens. After the round is fired and the pusher exits the gun, the pusher may separate from the projectile body and the second kinetic energy absorber may separate from the imaging sensor.

The sensor lens may include a convex surface that is substantially contiguous with a concave surface of the second kinetic energy absorber. The pusher may include a concave surface that is substantially contiguous with a convex surface of the second kinetic energy absorber.

The projectile body may include a plurality of aft-extending legs. Each leg may include a flat portion that rests on a recessed shoulder of the first kinetic energy absorber. The first kinetic energy absorber may include an annular recessed base for receiving flat portions of the sensor lens.

Another aspect of the invention is a method that may include providing a round and firing the round from a gun. A projectile body in the round may be propelled by a pusher in the round. After the pusher exits the gun and while the round is airborne, the pusher may separate from the projectile body and a kinetic energy absorber may separate from a sensor lens.

The impact of an imaging sensor in the round may be cushioned by a kinetic energy absorber. After impact, the imaging sensor may be used to generate images of an area around the impact point.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1B:
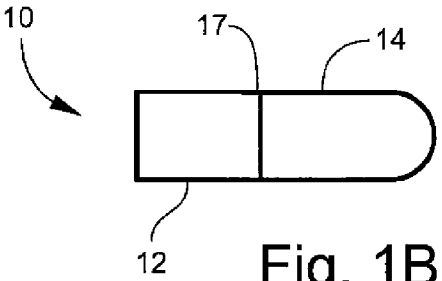
FIG. 1B is a schematic side view of one embodiment of a gun-launched round.
Figure 1A:
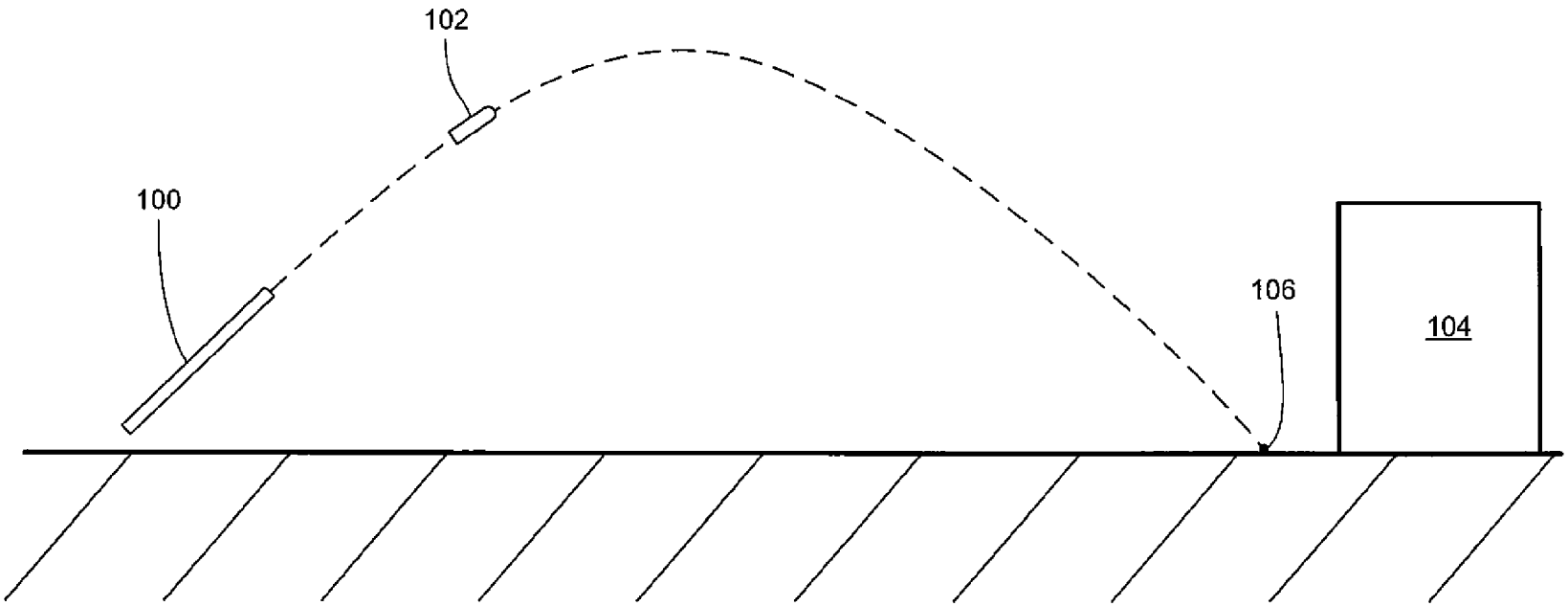
FIG. 1A is a schematic drawing of a gun and a gun-launched projectile.

FIG. 1A is a schematic drawing of a gun 100 for launching a projectile 102 toward a target or area of interest 104. Projectile 102 may impact at point 106. After impact, projectile 102 may gather information from area of interest 104 using sensors in projectile 102. The information may be, for example, wirelessly communicated from projectile 102 to a remote location.

FIG. 1B is a schematic side view of one embodiment of a gun-launched round 10 that may include a projectile, similar to projectile 102. Round 10 may include a cartridge case 12 and a projectile 14. Cartridge case 12 may be, for example, crimped to projectile 14 at area 17. Disposed in cartridge case 12 may be conventional propellant (not shown) and a primer (not shown) for igniting the propellant. In one embodiment, cartridge case 12 may be a 40 mm cartridge case.

Figure 2:
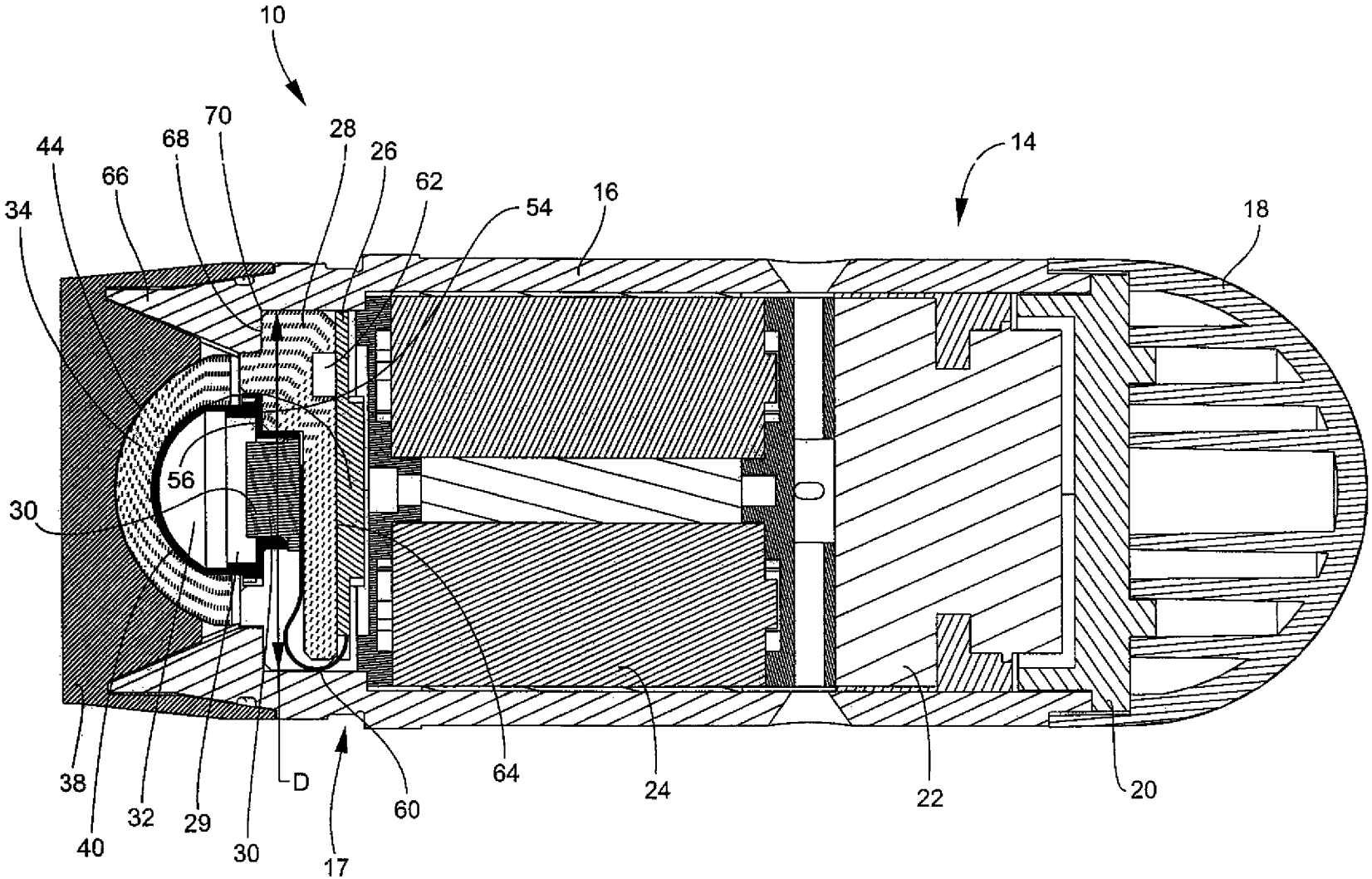
FIG. 2 is a longitudinal sectional view of the round of FIG. 1B, with the cartridge case removed.

FIG. 2 is a longitudinal sectional view of round 10 and projectile 14 of FIG. 1B, with cartridge case 12 removed. Projectile 14 may include a projectile body 16. A pusher 38 may be disposed aft of projectile body 16. Pusher 38 may be operable to push projectile body 16 upon firing round 10. Round 10 may include a nose 18, a separator plate 20, and electronics 22. Electronics 22 may include sensing devices, GPS devices, and/or wireless transmission devices, for example. Batteries 24 may be disposed aft of electronics 22. A sensor circuit board 26 may be disposed aft of batteries 24. A first kinetic energy absorber 28 may be disposed aft of circuit board 26. An imaging sensor 29 may be disposed at least partially in projectile body 16. Imaging sensor 29 may a sensor base 30 and sensor lens 32. Imaging sensor 29 may be, for example, a passive infrared sensor.

First kinetic energy absorber 28 may be disposed around sensor base 30 of imaging sensor 29. A second kinetic energy absorber 34 may be disposed around sensor lens 32 of imaging sensor 29. First and second kinetic energy absorbers 28, 34 may comprise a thermoset viscoelastic polymer, such as, for example, Sorbothane®, which is sold by Sorbothane Incorporated, Kent, Ohio, USA.

Figure 3B:
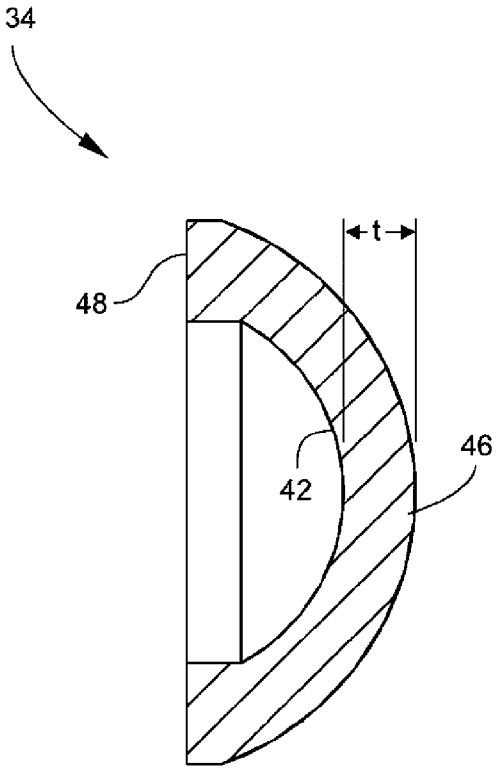
FIG. 3B is a sectional view along the line 3B-3B of FIG. 3A.
Figure 3A:
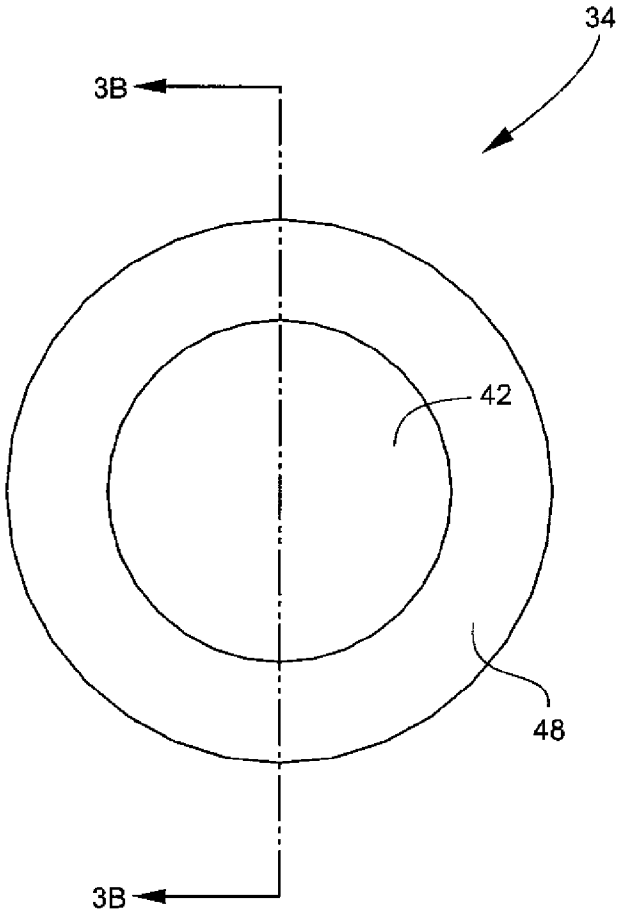
FIG. 3A is a bottom view of one embodiment of a launch acceleration kinetic energy absorber.

FIG. 3A is a bottom view of one embodiment of second kinetic energy absorber 34. FIG. 3B is a sectional view along the line 3B-3B of FIG. 3A. In one embodiment, absorber 34 may have a generally hemispherical shape. Lens 32 (FIG. 2) may include a convex surface 40 that may be substantially contiguous with a concave surface 42 of second kinetic energy absorber 34. Pusher 38 (FIG. 2) may include a concave surface 44 that may be substantially contiguous with a convex surface 46 of second kinetic energy absorber 34. Second absorber 34 may include an annular base 48. At the longitudinal centerline of projectile 14, a distance (thickness) "t" as shown in FIG. 3B, between concave and convex surfaces 42, 46 of second absorber 34 may be determined by the expected magnitude of acceleration forces that may be experienced by projectile 14 during launch. In one embodiment, thickness "t" may be in a range of about 0.8 inches to about 0.16 inches.

Figures 4A, 4B, 4C:
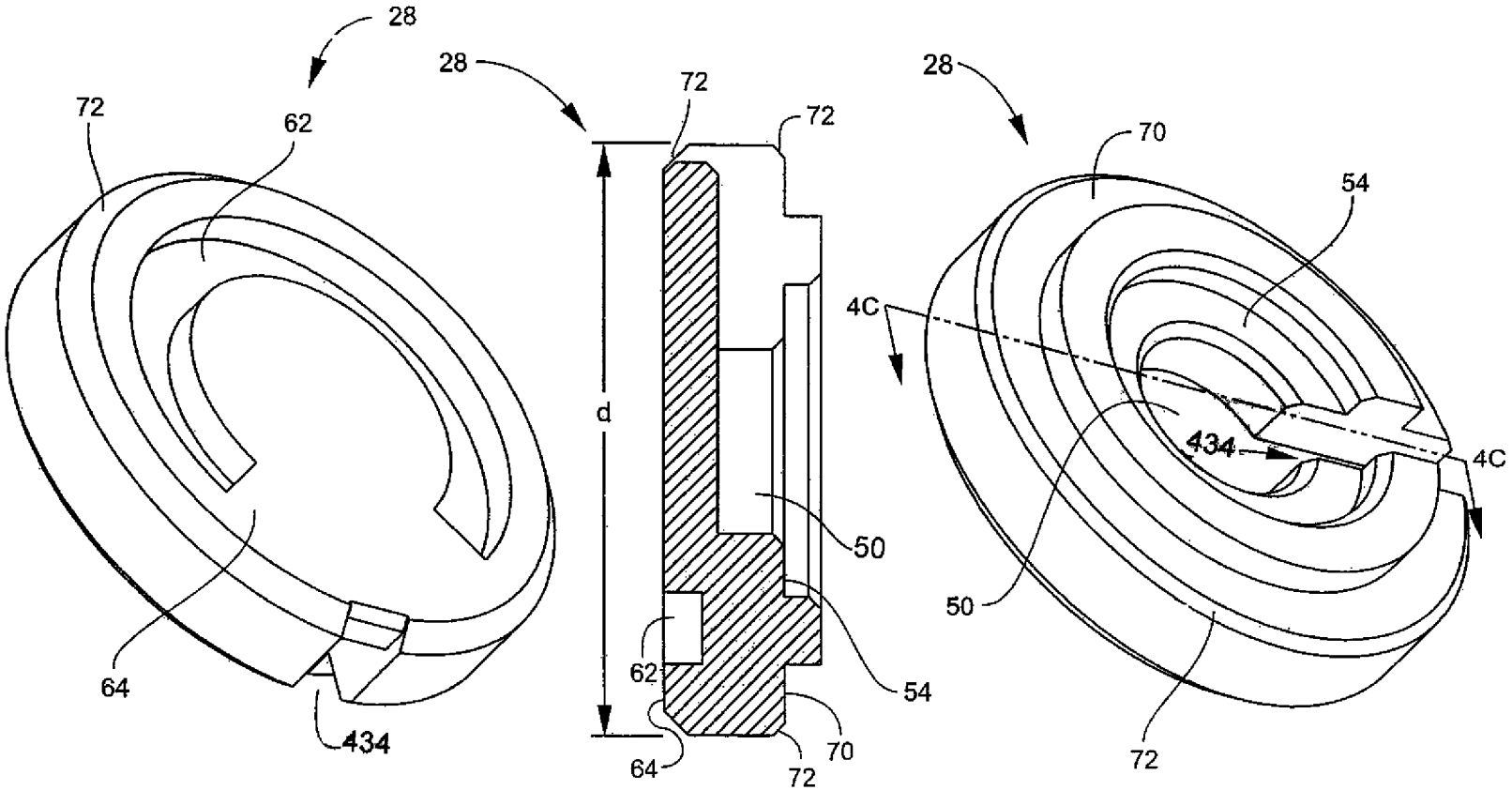
FIGS. 4A and 4B are forward and aft perspective views, respectively, of one embodiment of an impact acceleration kinetic energy absorber.
FIG. 4C is a sectional view along a bisecting plane 4C-4C of FIG. 4B.

FIGS. 4A and 4B are forward and aft perspective views, respectively, of one embodiment of first kinetic energy absorber 28. FIG. 4C is a sectional view along a bisecting plane 4C-4C of FIG. 4B. First kinetic energy absorber 28 may be generally disc-shaped. An outer diameter "d" (as shown in FIG. 4C) of first absorber 28 may be slightly less than inner diameter D (FIG. 2) of projectile body 16 to provide a snug fit therein. As shown in FIG. 2, projectile body 16 may include a plurality of legs 66 that extend aft. Legs 66 may include flat portions 68 that rest on recessed shoulder 70 of absorber 28. Flat portions 68 of legs 66 may secure absorber 28 in projectile body 16. Absorber 28 may be compressed against flat portions 68 by the weight of the components located forward of absorber 28, for example, circuit board 26, batteries 24, and electronics 22.

Absorber 28 may include a recessed portion 50 (FIG. 4B) for receiving sensor base 30 (FIG. 2) of imaging sensor 29. Absorber 28 may include an annular recessed base 54 for receiving flat portions 56 (FIG. 2) of lens 32. A slot 434 may extend from recessed portion 50 radially outward to house a wire 60 (FIG. 2) that may connect imaging sensor 29 with circuit board 26. A bottom 64 of absorber 28 may include an opening 62 for receiving components of circuit board 26. Chamfers 72 (FIGS. 4A-4C) may be formed on absorber 28 to create free volume for absorber 28 to fill during compression of absorber 28 upon impact of projectile body 16 at impact point 106.

Figure 5:
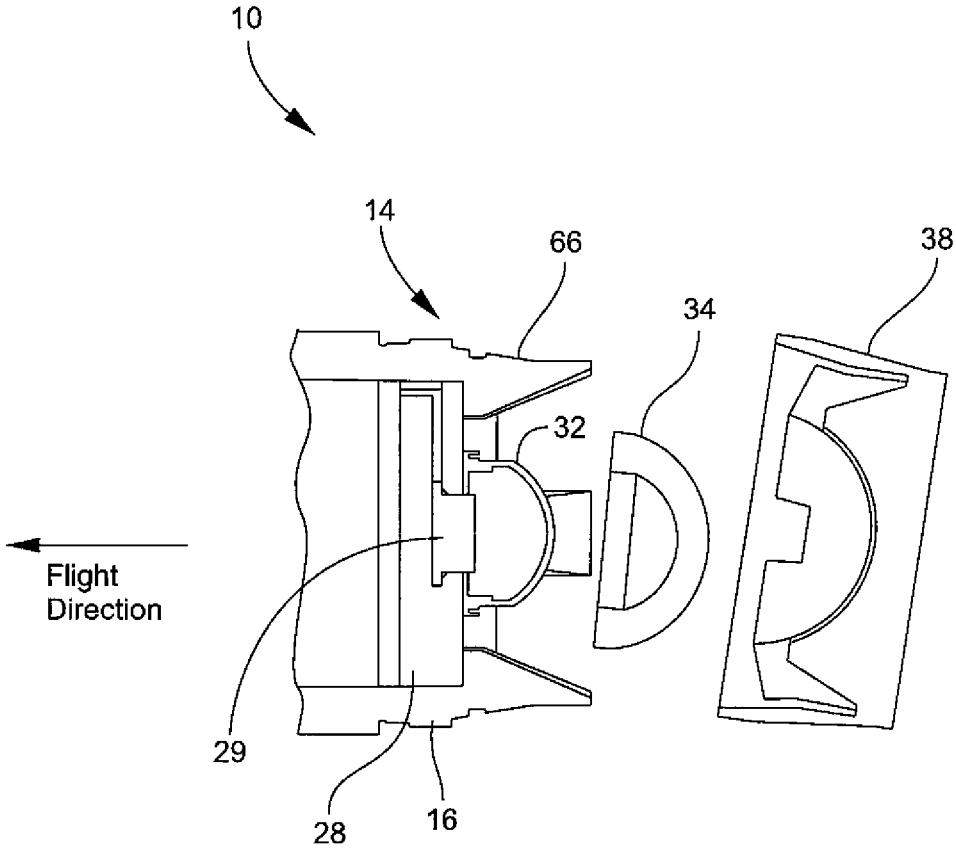
FIG. 5 is a schematic drawing of a portion of the round of FIG. 2, after exiting the gun muzzle.

In one embodiment, a method may include providing round 10 and firing round 10 in gun 100. Pusher 38 may propel projectile body 16 through gun 100. As shown in FIG. 5, when pusher 38 exits gun 10, pusher 38 may separate from projectile body 16 and fall to the ground. Aerodynamic force and/or gravity may cause pusher 38 to separate from projectile body 16. In addition, second kinetic energy absorber 34 may separate from lens 32 of imaging sensor 29 and fall to the ground. Aerodynamic force and/or gravity may cause absorber 34 to separate from imaging sensor 29.

When projectile 14 reaches impact point 106, the force of impact on imaging sensor 29 may be cushioned by first kinetic energy absorber 28. After impact, imaging sensor 29 may be used to generate images of area 104 around impact point 106.

A series of tests were conducted to determine the effectiveness of first and second kinetic energy absorbers 28, 34. Projectiles were launched from an air-gun to simulate launch and impact. Some projectiles had kinetic energy absorbers 28, 34 and some projectiles did not. Imaging sensors 29 were X-rayed after each shot to determine their survivability. Without energy absorbers 28, 34, imaging sensor 29 consistently failed. With energy absorbers 28, 34, imaging sensor 29 survived the launch and impact. Because an air gun was used, the impact forces were less than may be expected in a normal scenario. Additional tests are planned to better simulate actual impact forces.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A round for launching from a gun, the round comprising:

a cartridge case;

a projectile body adjacent the cartridge case, wherein the cartridge case is crimped to the projectile body, and wherein the projectile body includes a plurality of aft-extending legs, each leg including a flat portion thereon;

a pusher having a concave surface, said pusher disposed in the cartridge case and operable to push the projectile body upon firing the round;

an imaging sensor comprising a passive infrared sensor, said imaging sensor disposed at least partially in the projectile body, said imaging sensor including a sensor lens including a convex surface, and a sensor base;

a first kinetic energy absorber comprising Sorbothane® disposed around said sensor base; and a second kinetic energy absorber comprising Sorbothane® disposed around the sensor lens, wherein after the round is fired and the pusher exits the gun, the pusher separates from the projectile body and the second kinetic energy absorber separates from the imaging sensor, and wherein said second KE absorber is a hollow generally hemispherical shape with an annular base, and wherein said second KE absorber has an outer concave surface sized to mate to the imaging sensor lens convex surface, and wherein said second KE absorber also has an inner convex surface that is sized to mate to the concave surface of the pusher, and whereby said second kinetic further has a thickness "t" along a longitudinal centerline between the concave and convex surfaces of said second absorber, "t" being determined by the expected magnitude of acceleration forces that may be experienced by the projectile during launch.

2. The round of claim 1 wherein "t" is equal to about 0.8 inches to about 0.16 inches.

3. The round of claim 2 wherein said first KE absorber is generally disc-shaped and has an outer diameter "d" slightly less than an inner diameter "D" of the projectile body, and wherein the circumferences on both faces of said first KE absorber are chamfered to create free volume for said first KE absorber to fill during compression of said first KE absorber upon impact of the projectile body at an impact point, and wherein a first face of said first KE absorber has a first recessed shoulder sized to rest flat portions of a plurality of aft extending legs of the projectile body and also to secure said first KE absorber in the projectile body by the first KE absorber being compressed against the flat portions by weight of a circuit board, batteries, and electronic components located forward of said first KE absorber, and whereby said first face also includes an annular recessed base sized for receiving flat portions of the sensor lens and said first face also has a countersunk recessed portion hole sized for receiving the sensor base of the imaging sensor, and said first face also has a slot that extends from said recessed portion hole radially outward, sized to house a wire for connecting the imaging sensor with the circuit board, and wherein said second face of said first KE absorber has an annular recessed area sized for also receiving components of the circuit board.

4. The round of claim 3, wherein the round is a 40 mm round.

5. A method, comprising:

providing the round of claim 4;

firing the round in the gun;

after the pusher exits the gun and while the round is airborne, separating the pusher from the projectile body and separating the second kinetic energy absorber from the sensor lens.

6. The method of claim 5, further comprising propelling the projectile body using the pusher.

7. The method of claim 5, further comprising cushioning an impact of the imaging sensor using the first kinetic energy absorber.

8. The method of claim 7, further comprising, after cushioning the impact, using the imaging sensor to generate images of an area around the impact point.

* * * * *